US006019099A

United States Patent [19]

Shimek et al.

[11] Patent Number: 6,019,099

[45] Date of Patent: Feb. 1, 2000

[54] HEAT REMOVAL SYSTEM FOR FIREPLACES

[75] Inventors: Ronald John Shimek, Prior Lake; Robb Edward Bennett, Jordan; Daniel Curtis Shimek, Apple Valley, all of Minn.

[73] Assignee: Heat-N-Glo Fireplace Products Inc., Lakeville, Minn.

[21] Appl. No.: 09/024,054

[22] Filed: Feb. 17, 1998

[51] Int. Cl.[7] ..... F23C 1/18; F24C 3/00; F24H 3/02

[52] U.S. Cl. ..... 126/512; 126/510; 126/509; 126/85 B; 126/110 B

[58] Field of Search ..... 126/509, 510, 126/512, 85 B, 110 B

[56] References Cited

U.S. PATENT DOCUMENTS

| | | | |
|---|---|---|---|
| 324,106 | 8/1885 | Hamilton | 126/509 |
| 2,186,539 | 1/1940 | Slayter et al. | 126/510 |
| 2,231,258 | 2/1941 | Elmore | 126/509 |
| 2,484,292 | 10/1949 | Hermanson | 126/512 |
| 3,834,619 | 9/1974 | Glover | 126/502 |
| 4,043,313 | 8/1977 | Sherman | 126/502 |
| 4,160,524 | 7/1979 | Stiber | 237/51 |
| 4,206,744 | 6/1980 | Mahoney et al. | 126/121 |
| 4,224,544 | 9/1980 | McKinnon et al. | 310/90 |
| 4,230,268 | 10/1980 | Gorman et al. | 126/509 |
| 4,243,177 | 1/1981 | Powers | 237/51 |
| 4,459,816 | 7/1984 | Lung et al. | 62/183 |
| 4,793,322 | 12/1988 | Shimek et al. | 126/80 |
| 4,817,391 | 4/1989 | Roe et al. | 62/17 |
| 4,987,748 | 1/1991 | Meckler | 62/176.1 |
| 5,127,878 | 7/1992 | Meckler | 454/264 |
| 5,392,763 | 2/1995 | Shaw et al. | 126/512 |
| 5,460,162 | 10/1995 | Binzer | 126/517 |
| 5,647,340 | 7/1997 | Shimek et al. | 126/85 B |
| 5,673,683 | 10/1997 | Beal et al. | 126/531 |

FOREIGN PATENT DOCUMENTS

| | | |
|---|---|---|
| 1020 | 3/1873 | United Kingdom . |
| 4066 | 7/1890 | United Kingdom . |
| 140989 | 4/1920 | United Kingdom . |

*Primary Examiner*—Ira S. Lazarus
*Assistant Examiner*—David Lee
*Attorney, Agent, or Firm*—John B. Sowell-Attorney

[57] ABSTRACT

A high efficiency gas fireplace unit having a heat exchanger is located in a room in which the heat from the gas fireplace is not wanted. An air duct is connected to the heat exchanger and has a termination point in a room or area remote from the gas fireplace unit. During a heat dump or heat transfer mode of operation, an induced draft fan in an air duct is activated by a remote switch thrown to cause room air to be sucked through the heat exchanger and passed through the air duct and dumped in a remote area so that the fireplace heating effect is nullified or neutralized allowing the fireplace to be operated with or without an air conditioning system.

14 Claims, 5 Drawing Sheets

HEAT REMOVAL SYSTEM FOR FIREPLACES

BACKGROUND OF THE INVENTION

1. Field of the Invention

The present invention relates to heat efficient gas log fireplaces. More particularly, the present invention relates to a method and apparatus for removing or nullifying the heat produced by a heat efficient fireplace and for controlling the heat being supplied to a remote room or space.

2. Description of the Prior Art

Gas log fireplaces are known for their decorative beauty and are being installed in many new houses, condominiums and apartments as a primary source of heat which may or may not be supplemented by a central cooling/heating system. In many geographic areas of the world where gas fireplaces have been installed, the room in which a conventional fireplace is located is too hot to be operated. If the gas supplied to the fireplace is turned down to avoid heating the room, the decorative effect of the long flames of a fireplace is substantially lost.

Such problems can occur when a gas fireplace is used as a heat source and is controlled by a thermostat. If the room is already warm and/or crowded with people, the thermostat needs to be turned up beyond the normal set point to activate the burner system.

Fireplaces having heat exchangers are often turned down or off to deactivate the heat exchanger to limit the heat transmitted to the room. It is known that under the above conditions where a gas log fireplace overheats a room, that some people have turned on their air conditioners to counterbalance or nullify the excess heat from the fireplace unit. Some homes in moderate climate zones have log fireplaces but have no air conditioners which could be used to nullify or balance an active fireplace.

In our U.S. application Ser. No. 08/588,865 filed Jan. 19 1996 entitled "Integrated Gas Fireplace and Air Conditioning System" there is shown a system capable of controlling the temperature of a room at a desired comfort temperature while providing a fireplace or flaming logs under the extremes of outside climate conditions. Such systems are easily installed in new homes, however, such dual systems are not easily adapted to homes with permanent heating and air conditioning systems already installed. When both permanent systems are operated simultaneously with one or even two thermostats, an unbalanced condition is created in the rooms remote from the fireplace. Accordingly, it would be highly desirable to provide a conventional prefabricated gas log fireplace that could be operated in a no heat or low heat mode of operation with the flip of an electrical switch or the equivalent thereof.

SUMMARY OF THE INVENTION

It is a primary object of the present invention to provide a method and means for diverting heat from a flaming log fireplace to an outside source away from a room in which the fireplace is located.

It is another primary object of the present invention to provide a novel heat dump structure which literally sucks the heat out of a fireplace and places it at some remote desirable place.

It is another principal object of the present invention to provide means for diverting heat from a flaming log fireplace to other rooms or areas where the heat is needed or desired.

It is yet another primary object of the present invention to provide a system for removing heat from a fireplace which nullifies the normal operation of an air conditioning system.

It is yet another primary object of the present invention to convert a flaming log fireplace in one room to an auxiliary source of heat in another room while maintaining high thermal efficiency.

It is yet another object of the present invention to provide a novel heat dump system which may be incorporated into new or existing prefabricated fireplaces for various reasons, one of which is to eliminate conventional heat from one source and transfer it to another.

It is yet another feature of the present invention to reverse the heat dump mode of operation so as to provide fresh heated air into a room or area that has been designed so tight that an inadequate supply of fresh outside air is the problem to be solved.

It is a general object of the present invention to provide a heat removal and heat dump system for removing heat from a fireplace which would otherwise overload an air conditioning system in a hot desert geographical area.

According to these and other objects of the present invention, there is provided a conventional gas log fireplace having a combustion chamber and some form of heat exchanger which collects heat from the combustion chamber for transfer into a room. Heat evacuation duct means are coupled to the heat exchanger which are normally inactive when a fireplace is operative in its conventional mode. In the heat transfer mode, a blower or blowers in remote rooms are activated so that the heat from the heat exchanger is diverted to the remote area.

In a heat neutralization mode, heat from the room in which the fireplace is located may be drawn through both the inlet and outlet of the fireplace heat exchanger and dumped or transferred to a remote area. In the heat dump mode, outside fresh air may be supplied into the heat exchanger. In another mode of operation, a bleeder system may be provided which supplies fresh air in at least an equal amount of air from the outside to the room being evacuated by the heat dump system. One or more of these modes of operations are capable of being operated individually or simultaneously and controlled by different thermostats or switches.

DETAILED DESCRIPTION OF THE PREFERRED EMBODIMENTS

Figure 1:
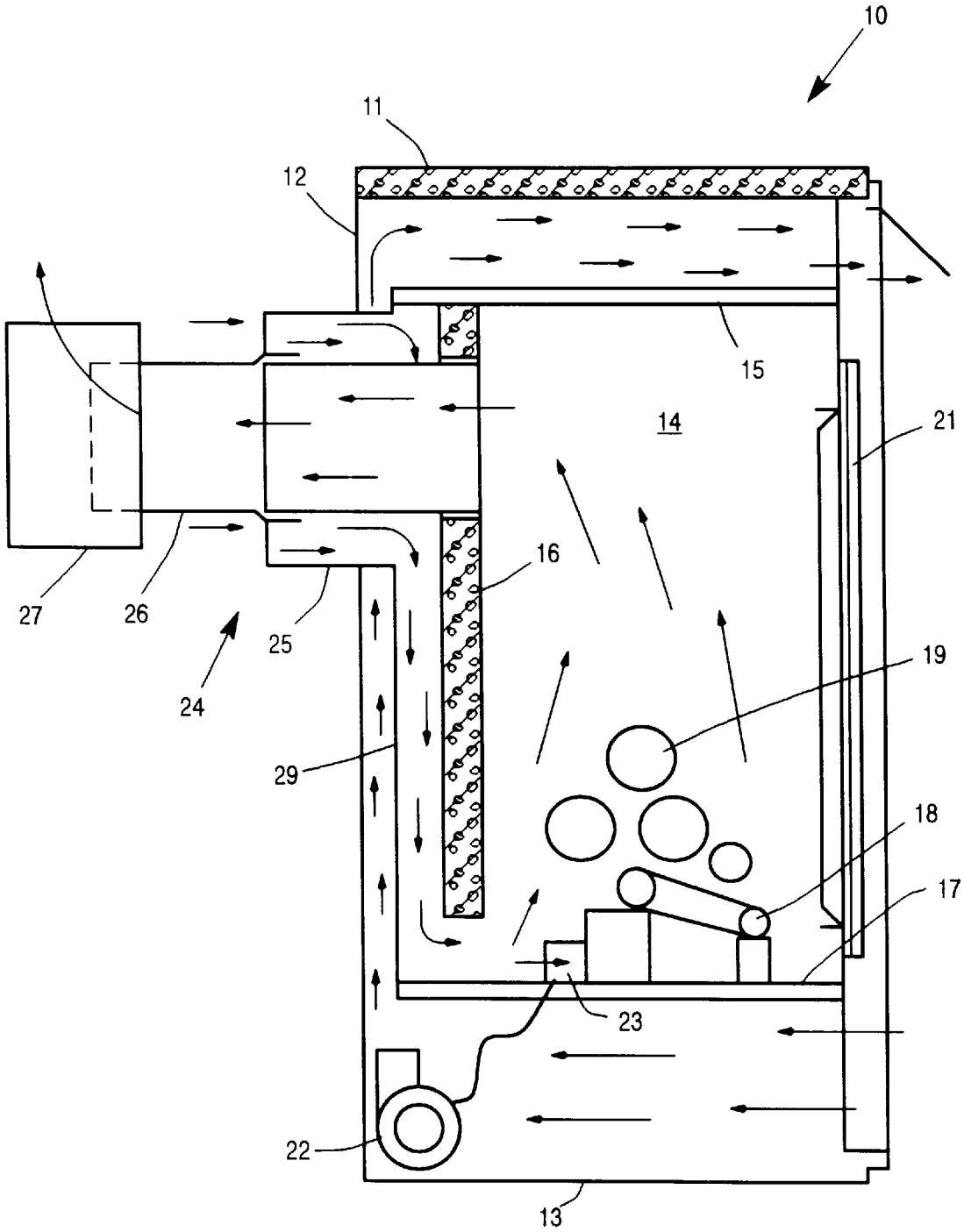
Figure 1 Prior Art
FIG. 1 is a schematic drawing in side elevation of a prior art horizontal direct vent fireplace having a forced air heat exchanger.

Refer now to FIG. 1 showing a prior art horizontal direct vent fireplace 10 which comprises an outer housing having a top panel 11, a back panel 12 and a bottom panel 13. The side panels form an open box closure but are not shown. Inside of the housing is a combustion chamber 14 having a top panel 15, a back panel 16 and a floor panel 17. Inside of the combustion chamber is burner system 18 and a gas log set 19. The front of the housing is provided with either operable glass doors or a sealed glass panel 21. In the heat exchanger formed by the walls between the outer housing and the combustion chamber, there is shown in the bottom wall a blower motor 22 which is connected to a thermal switch 23. When the combustion chamber 14 is heated to approximately 90°, the thermal switch turns on the blower 22 causing circulation of room air through the heat exchanger as shown by the arrows.

Gas from the burner system 18 pulls in outside combustion air through the coaxial pipe 24 which comprises an outer pipe 25 and an inner exhaust pipe 26. The burned combustion product is exhausted through the exhaust pipe or exhaust stack 26 and exits upward through serrated or apertured vent cap 27. In the normal mode of operation, the prior art fireplace 10 cannot be operated at its fullest capacity and dry hot areas such as Arizona and Southern California without supplying unwanted heat to the room in which the fireplace is located.

Figure 2:
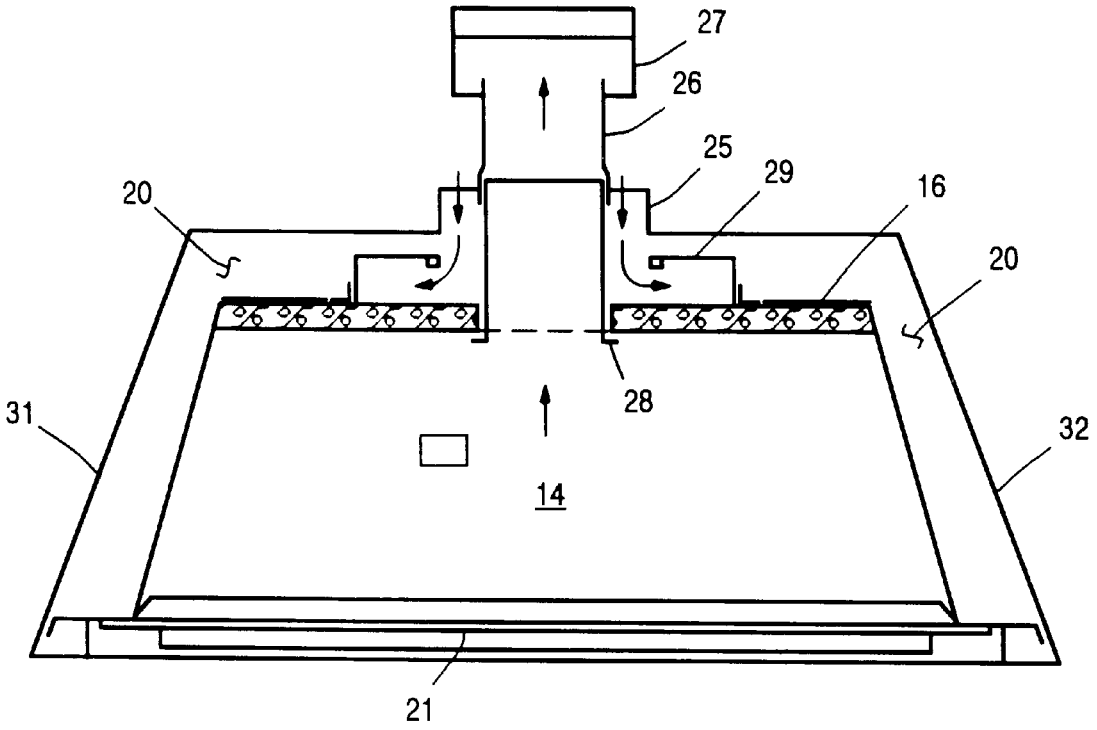
Figure 2 Prior Art
FIG. 2 is a schematic drawing taken through the exhaust stack of the fireplace shown in FIG. 1.

Refer now to FIG. 2 showing a schematic drawing in plan view and section taken through the exhaust stack 26. The exhaust stack 26 comprises an exhaust collar 28 and the aforementioned exhaust pipe 26 which connects to the exhaust vent 27. Outside fresh air enters into the fresh air pipe 25 and proceeds downward in the duct or housing 29 before entering under the back panel 16 and into the combustion chamber 14. FIG. 2 more clearly shows the heat exchanger formed by the juxtaposed panels of the combustion chamber 14 and the outer housing which includes side panels 31 and 32.

Figure 3:
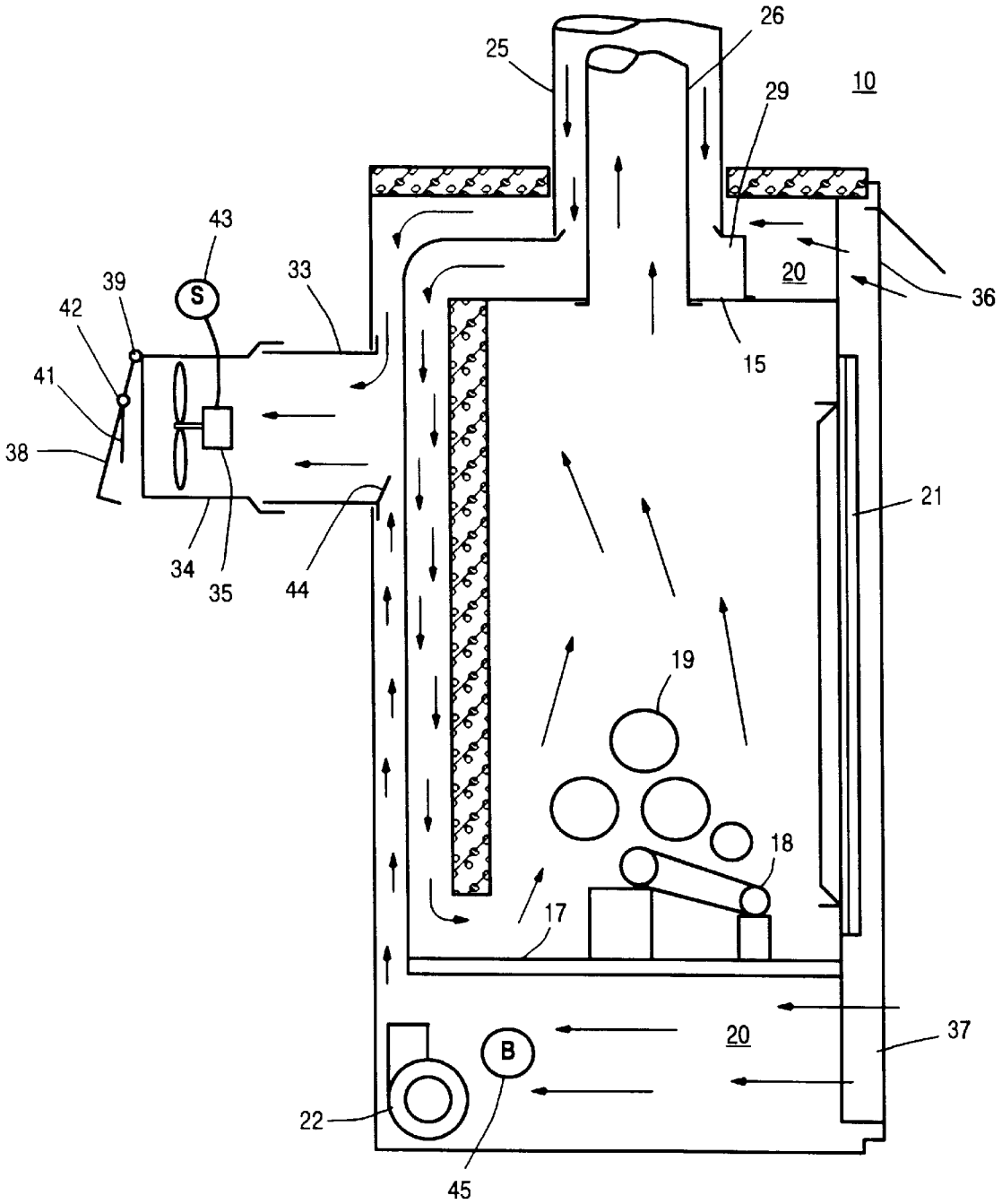
FIG. 3 is a schematic drawing in side elevation showing a preferred embodiment of the present invention direct vent fireplace with a vertical stack and having a horizontal dump vent powered by a reversible motor coupled to the heat exchanger.

Refer now to FIG. 3 showing a schematic drawing in side elevation of a direct vent fireplace of the type shown in FIGS. 1 and 2 which has been modified to provide a horizontal dump vent powered by a reversible motor as will be explained. In this embodiment, the prior art heat exchanger motor 22 may be maintained for moderate climate geographical zones where a heat exchanger can be utilized in colder months. In the preferred embodiment of the present invention, a horizontal evacuation duct 33 is connected directly into the back of the heat exchanger 20. The air duct 33 may be formed similar to the exhaust collar 28 and is further coupled to a motor housing 34 which may be formed from a cylindrical pipe which forms an extension of the air duct 33. Mounted inside of the motor housing 34 is reversible motor 35 which serves as an induced draft fan in one mode and a forced draft fan in second mode. When the motor 35 is operated in an induced draft fan mode, it sucks air into both grills 36 and 37 of the heat exchanger and pushes the air past the damper assembly 38. The damper assembly 38 is shown having a large damper plate which is pivoted at pivot point 39 and serves as a mounting structure for a small damper plate 41 which is pivoted at pivot point 42. In the heat dump or exhaust mode, the larger damper plate 38 pivots at pivot point 39 and the small damper plate 41 is closed. In the heat exchange mode when the motor 35 is reversed damper plate 38 is closed and damper plate 41 opens to allow outside fresh air to be blown in through air duct 33 and into the heat exchanger 20 which exits through the grills 36 and 37 as preheated outside air. In the preferred embodiment of the present invention, the motor 35 is controlled by a remote switch 43 and preferably has a LED indicator on the switch to denote when the motor 35 is in the heat dump mode. When the fireplace 10 is supplied with the optional motor 22, the motor 35 may be completely turned off and the motor 22 turned on so that the heat exchanger 20 operates in its most efficient mode. In this mode of operation an aspiration or damper plate 44 may be provided at the lower edge of the air duct 33 so that the damper 41 does not open due to aspiration of air passing the air duct 33.

In the preferred embodiment of the present invention, there is shown a bleeder 45 which permits fresh outside air to enter into the heat exchanger and the room in which the fireplace is located to neutralize negative pressure in the dump mode.

Figure 4:
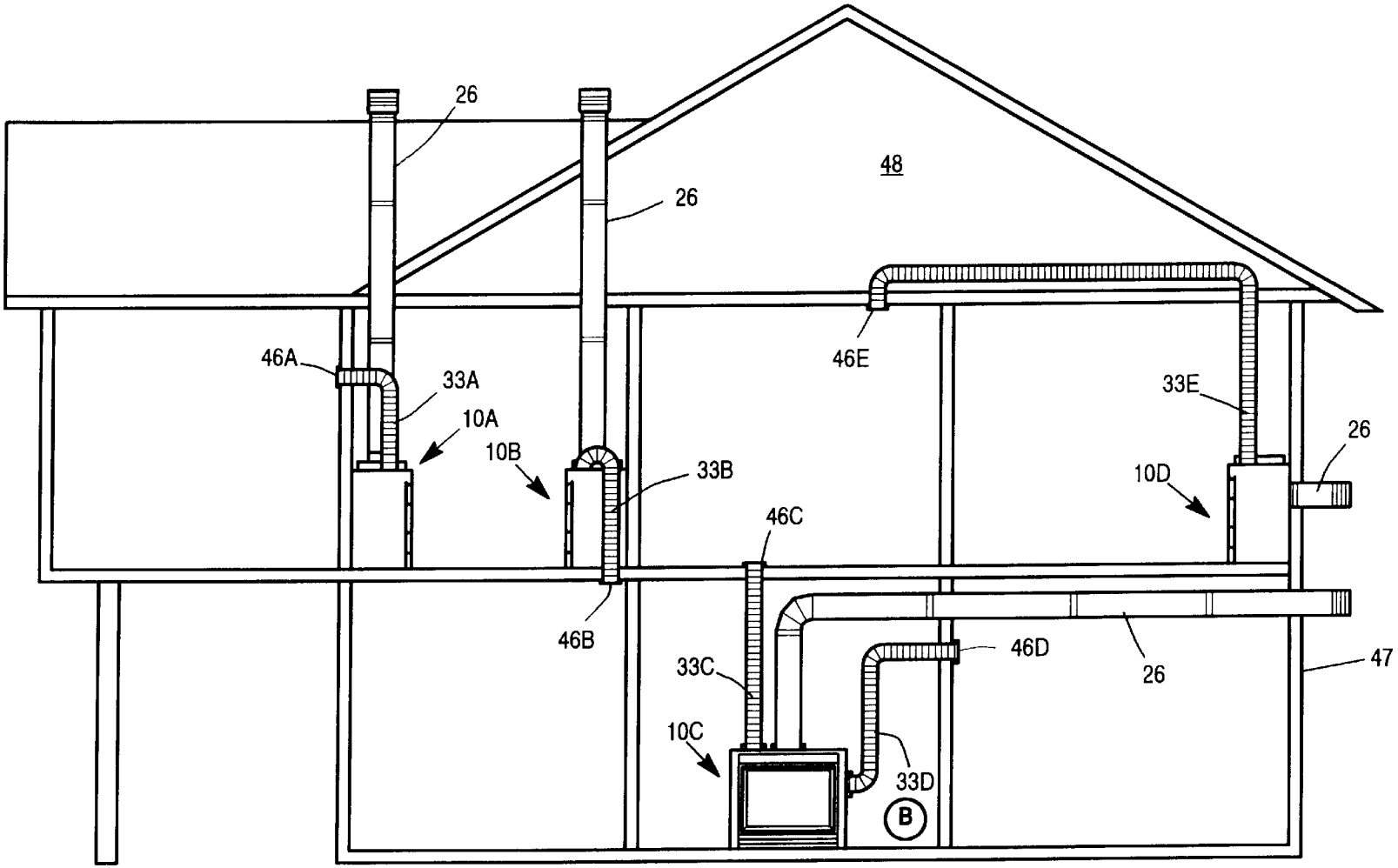
FIG. 4 is a schematic drawing in elevation of a large multi-story dwelling which is heated by a plurality of fireplaces employing the present heat dump principal.

Refer now to FIG. 4 showing a schematic drawing in elevation of a large multi-story dwelling which is heated by a plurality of fireplaces like fireplace 10 employing the heat dump principal explained hereinbefore. Fireplace 10A is shown having a horizontal and then vertical air duct 33A which terminates at a register 46A which will be explained in greater detail hereinafter. The fireplace 10A is shown having a vertical exhaust duct 26. The fireplace 10A effectively transfers heat from one room to an adjacent room in a horizontal direction.

Refer to fireplace 10B which has a vertical duct 26 and an air duct 33B which reverses direction by 180° and terminates in a register 46B which exits into a room below the fireplace 10B.

Refer now to fireplace 10C which has a vertical air duct 33C which terminates in a register 46C located in a room above the fireplace IOC. The same fireplace 10C is shown having a air duct 33D which connects into one of the sides of the housing 10 described in FIG. 2 and into the heat exchanger and terminates into an adjacent room at a register 46D. In this embodiment, the exhaust duct 26 is shown vertical and horizontal and passing through two room walls and terminating on the outside of outside wall 47.

Refer now to fireplace 10D which has an air duct 33E which starts out in a vertical direction and passes horizontally in an attic space 48 and then is directed vertically downward into a register 46E in a room which is adjacent to the room in which fireplace 10D is located. Fireplace 10D is shown having a horizontal exhaust duct system 26 which also exits through wall 47.

It will be understood that a typical house would not employ all of the fireplaces 10A through 10D and that the placement of the fireplaces-in the different rooms of FIG. 4 is for illustration purposes only. Having explained that a fireplace 10 may be located in one room and the heat from its heat exchanger extracted and supplied to another room with little or no expense to the fireplace is the principal to be illustrated.

Figure 5:
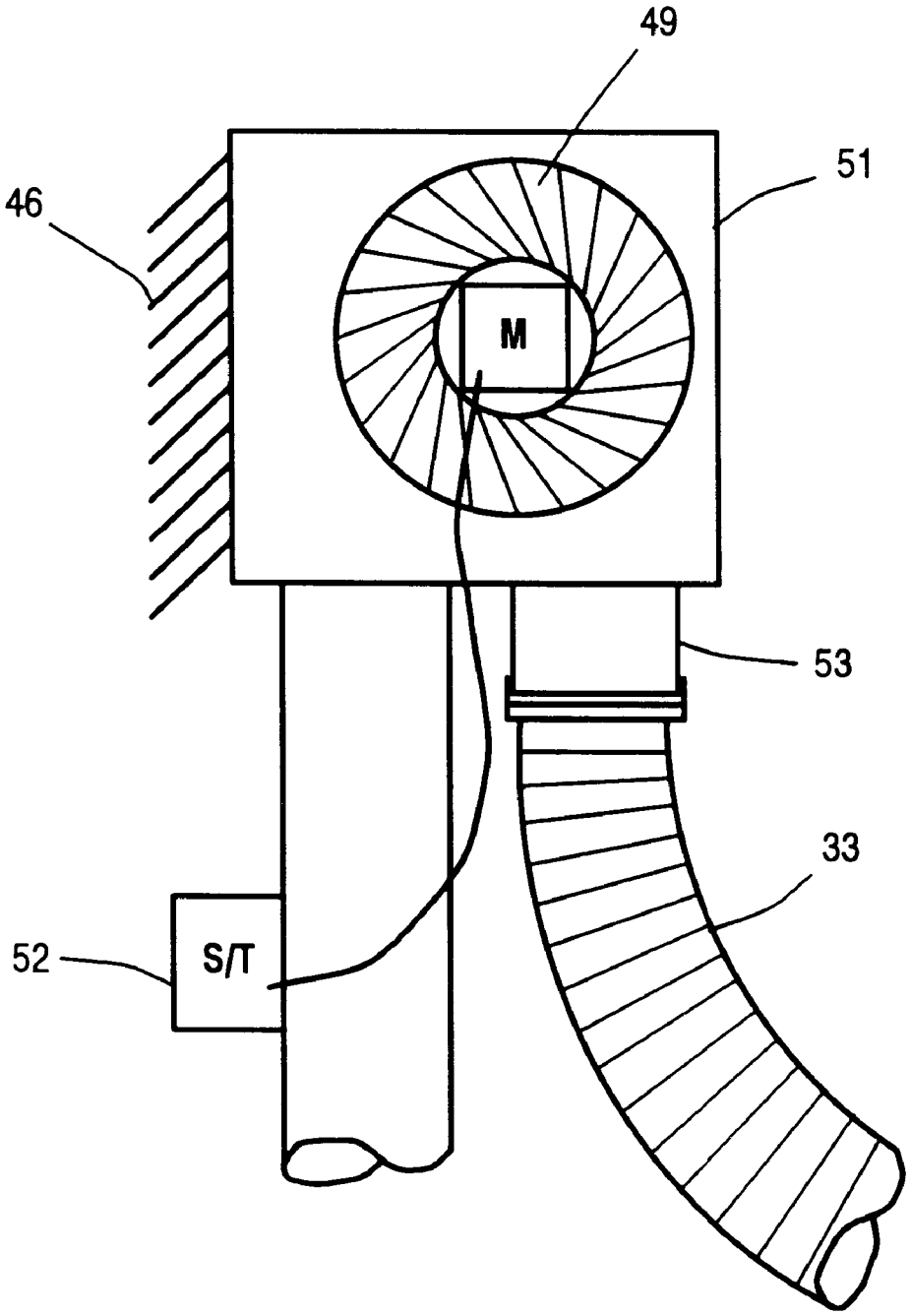
FIG. 5 is a schematic drawing of a blower motor of the type employed in a register box to directly transfer heat from a fireplace into a room remote from the fireplace.

Refer now to FIG. 5 showing a preferred embodiment induced draft fan 49 which is located inside of a housing 51 and is operable by a remote control thermostat or switch 52 which may be located on a wall at the register 46 or at some other location. The housing 51 in which the squirrel cage fan is located is provided with an duct adapter 53 which connects to the air duct 33 described hereinbefore.

Having explained FIGS. 4 and 5, it will be appreciated that the heat dump principal may be employed to transfer heat from any fireplace through an air duct 33 to a housing 51 using an induced draft fan motor to supply warm air through a register 46 into another room.

Having explained the preferred embodiment invention with reference to FIG. 3, it will be appreciated that heat from a heat producing fireplace 10 may be neutralized or nullified by using a heat dump apparatus and system as shown in FIG.

3 to draw the heat off of the combustion chamber and through an air duct 33 which dumps the heat to an outside area. It is now possible for people who live in extremely warm climates to enjoy the aesthetic and decorative effects of a real fireplace without nullifying or canceling the effect of their air conditioning systems while preserving the ability to use their fireplace in a normal efficient heat transfer mode when necessary.

What is claimed is:

1. A prefabricated gas fireplace for removing heat from a fireplace room and transferring it to an area remote from the fireplace room, comprising:

said fireplace having an outer housing, a combustion chamber inside of said fireplace housing, a heat exchanger having a plurality of connecting passageways mounted on the outside of said combustion chamber and having an inlet and an outlet in said fireplace room for normally circulating room air to be heated through the heat exchanger passageways around said combustion chamber and back into said fireplace room, heat dump transfer air duct means connected into the back or top of said heat exchanger passageways for removing both air and heat from said fireplace room, said heat dump transfer air duct means terminating in a remote room or area where the heat from said room and heat exchanger is transported, induced air fan means connected to said heat dump transfer air duct means for inducing fireplace room air flow into said inlet and said outlet of said heat exchanger, and switch means for activating and deactivating said induced air fan means for removing heat generated in said heat exchanger with room air from said fireplace room and dumping it into another space or area remote from said fireplace room.

2. A gas fireplace as set forth in claim 1 which further includes damper blocking means for automatically closing off said heat dump transfer air duct means when said heat dump transfer air means is not activated.

3. A gas fireplace as set forth in claim 2 which further includes an aspiration deflector means connected in said heat exchanger for reducing negative aspiration effect caused by air being circulated through said heat exchanger.

4. A gas fireplace as set forth in claim 1 wherein said heat dump transfer air duct means and said induced draft fan means are operable to displace room air through said inlet and said outlet of said heat exchanger to an outside area, whereby heat from said fireplace is removed from said fireplace room.

5. A gas fireplace as set forth in claim 4 which further includes a bleeder circuit for neutralizing the negative pressure produced in the heat exchanger during the heat dump operation.

6. A gas fireplace as set forth in claim 4 wherein said induced air fan means is operable in a reverse mode to pump outside fresh air into said air duct means and for supplying outside fresh air through said heat exchanger to said fireplace room.

7. A method of heating an area remote from a gas fireplace by dumping heat generated in said fireplace, comprising the steps of:

starting a gas fireplace to produce decorative flames and heat, connecting one end of a heat dump transfer air duct to said heat exchanger and the other end to a dump area remote from said gas fireplace, generating heat in the heat exchanger of said gas fireplace which normally would be conducted into the fireplace room area adjacent to said gas fireplace, generating a partial vacuum in said heat dump transfer air duct connected to said heat exchanger, conducting the room air heat from said fireplace room and said heat exchanger through said transfer air duct, and dumping the conducted room air heat in an area which is remote from said fireplace area, whereby fireplace room heat is removed from said fireplace room.

8. A method of heating a remote area with dump heat as set forth in claim 7 wherein the step of dumping includes the step of dumping the conducted heat to an external outside source, and removing substantially all convection heat from said heat exchanger of said fireplace with air from said fireplace room area.

9. A method of heating a remote area with dump heat as set forth in claim 7 which further includes the step of transferring heat from said fireplace area to a remote room area with an induced draft fan in said transfer air duct.

10. A method as set forth in claim 9 which further includes selectively activating said induced draft fan.

11. A method as set forth in claim 10 wherein the step of activating further includes providing thermostat means in said fireplace room for actuating switch means.

12. A method as set forth in claim 10 wherein the step of activating further includes providing thermostat means in said remote room for actuating switch means.

13. A prefabricated gas fireplace operable for dumping heat in an area remote from said fireplace area, comprising:

a fireplace having an outer housing, a combustion chamber inside of said fireplace housing, a heat exchanger having an inlet grill and a plurality of connecting passageways outside of said combustion chamber for circulating air from a room to be heated through the heat exchange around said combustion chamber and through an outlet grill, heat dump transfer air duct means connected into one of said heat exchanger passageways, said heat dump transfer air duct means terminating in a room or area where room air and heat from said heat exchanger is disposed, induced air fan means connected in series in said heat dump transfer air duct means, switch means for activating and deactivating said induced air fan means for removing heat generated in said heat exchanger with room air and dumping it into another space or area remote from said fireplace area, thermostat means coupled to said switch means for controlling said induced air fan means, and aspiration injector means in said heat exchanger for reducing negative aspiration effect caused by air being circulated in said heat exchanger.

14. A gas fireplace as set forth in claim 13 which further includes damper blocking means for closing off one heat dump transfer air duct means when a second heat dump transfer air duct means is activated.

* * * * *